US008100729B2

(12) United States Patent
Chen et al.

(10) Patent No.: US 8,100,729 B2
(45) Date of Patent: Jan. 24, 2012

(54) CABLE CONNECTOR AND WIRING ASSEMBLY

(75) Inventors: Chun-Hsu Chen, Chung Ho (TW); Chun-Hua Chen, Chung Ho (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 12/777,328

(22) Filed: May 11, 2010

(65) Prior Publication Data

US 2010/0304615 A1 Dec. 2, 2010

(30) Foreign Application Priority Data

May 27, 2009 (TW) ..... 98209334

(51) Int. Cl.
*H01R 9/22* (2006.01)

(52) U.S. Cl. ..... 439/719; 439/942

(58) Field of Classification Search ..... 439/719, 439/942
See application file for complete search history.

(56) References Cited

U.S. PATENT DOCUMENTS 7,270,571 B1 * 9/2007 Huang et al. ..... 439/607.45

* cited by examiner

*Primary Examiner* — Ross Gushi
(74) *Attorney, Agent, or Firm* — Chun-Ming Shih; HDLS IPR Services

(57) ABSTRACT

A cable connector includes a connecting head, a wiring assembly and a cable. The cable is assembled with the wiring assembly, and then the wiring assembly is assembled with the connecting head, thereby forming a cable connector. The wiring assembly has a rear-half portion and a front-half portion that are connected to each other. The distal end of the rear-half portion is recessed to form a plurality of wiring ports. The interior of each wiring port is provided with a plurality of cable troughs. The cable troughs extend toward the front-half portion to form a plurality of wiring slots on the front-half portion.

7 Claims, 5 Drawing Sheets

CABLE CONNECTOR AND WIRING ASSEMBLY

BACKGROUND OF THE INVENTION

1. Field of the Invention

The present invention relates to a connector, and in particular to a cable connector and a wiring assembly.

2. Description of Prior Art

As shown in FIG. 1, in a conventional cable connector, an insulating body 1*a* and a cable 3*a* are connected via a wiring assembly 2*a*, so that respective cable-baring portions 300*a* on the distal end of each cable core 30*a* of the cable 3*a* can be arranged orderly at corresponding positions of the insulating body 1*a*. In this way, a soldering process or electrical connection can be performed easily. Further, the same cable core 30*a* comprises two transmission lines 31, 32*a* and a ground line 33*a* that are covered by an insulating layer respectively. The wiring assembly 2*a* is provided with a plurality of troughs 20*a* for allowing the two transmission lines 31*a*, 32*a* and the ground line 33*a* of each cable core 30*a* to be disposed therein. Thus, the short circuit caused by the possible contact of the cable-baring portions 300*a* can be prevented.

However, in such a wiring assembly 2*a* of the cable connector, the trough 20*a* is not provided with any distinguishable or recognizable shape or indicator. As a result, when an operator intends to insert the cable-baring portions 300*a* at the distal end of each cable core 300*a* of the cable 3*a* into the troughs, the operator may make mistake because he/she get confused by a great amount of cable-baring portions 300*a*. Thus, the operator may insert the respective cable-baring portions 300*a* into wrong troughs 20*a* easily, which makes the wiring procedure difficult and incorrect.

Therefore, in order to overcome the above problems, the present Inventor proposes a reasonable and novel structure based on his delicate researches and expert experiments.

SUMMARY OF THE INVENTION

The present invention is to provide a cable connector and a wiring assembly. Due to its improved structure, the operator can disposed respective cable-baring portions of the cable in correct positions orderly without making mistake. Thus, the assembling process can be performed more easily and correctly.

The present invention is to provide a cable connector, which includes a connecting head, a wiring assembly and a cable. The connecting head comprises a casing and an insulating body provided in the casing. The front end of the casing is recessed to form an insertion slot. The top and bottom inside the insertion slot are recessed to form a plurality of terminal seats and terminals respectively. The insulating body is disposed horizontally between the top and bottom terminal seats in the insertion slot. The wiring assembly has a rear-half portion and a front-half portion that are connected to each other. The distal end of the rear-half portion is recessed inwards to form a plurality of wiring ports. The interior of each wiring port is provided with a plurality of cable troughs. The cable troughs extend toward the front-half portion to form a plurality of wiring slots on the front-half portion. The cable comprises the same number of bundles of cable cores as the number of the wiring ports. The cable cores are located in the corresponding wiring ports respectively. The distal end of the respective cable core extends to form a plurality of cable-baring portions. The cable-baring portions are disposed in the corresponding wiring slots to be electrically connected with the terminals.

The present invention is to provide a wiring assembly of a cable connector, which is formed into a block having a rear-half portion and a front-half portion that are connected to each other. The distal end of the rear-half portion is recessed inwards to have a plurality of wiring ports. The interior of each wiring port is provided with a plurality of cable troughs. The cable troughs extend toward the front-half portion to form a plurality of wiring slots on the front-half portion.

According to the present invention, the mistake made in performing the wiring procedure of the cable connector can be reduced, so that the assembling process can be carried out more easily.

DETAILED DESCRIPTION OF THE INVENTION

In order to make the Examiner better understand the characteristics and technical contents of the present invention, a description relating thereto will be explained with reference to the accompanying drawings. However, the drawings are illustrative only but not used to limit the present invention.

Figure 1:
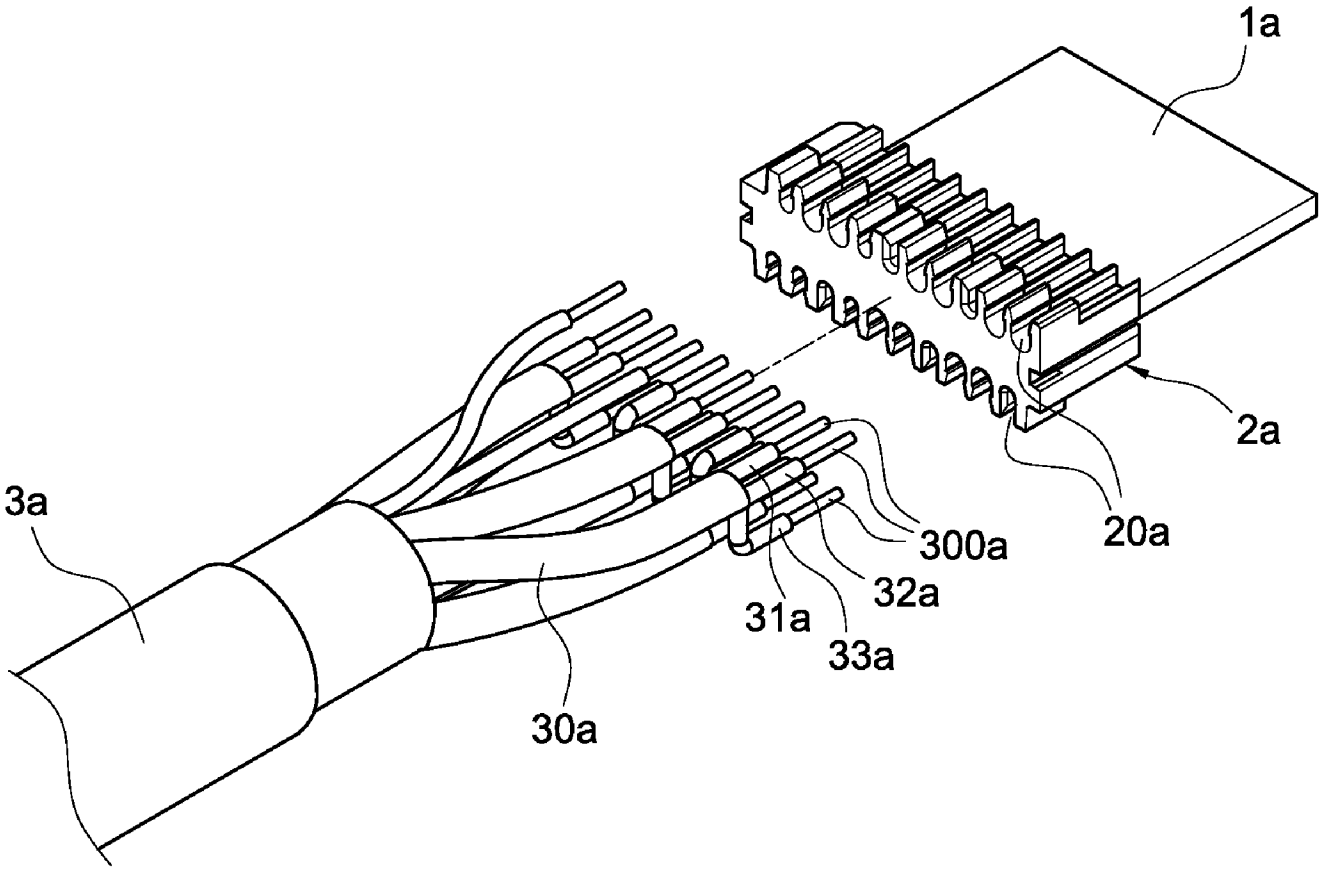
FIG.1 (Prior Art)
FIG. 1 is an exploded view showing the wiring assembly of the cable connector in prior art.
Figure 2:
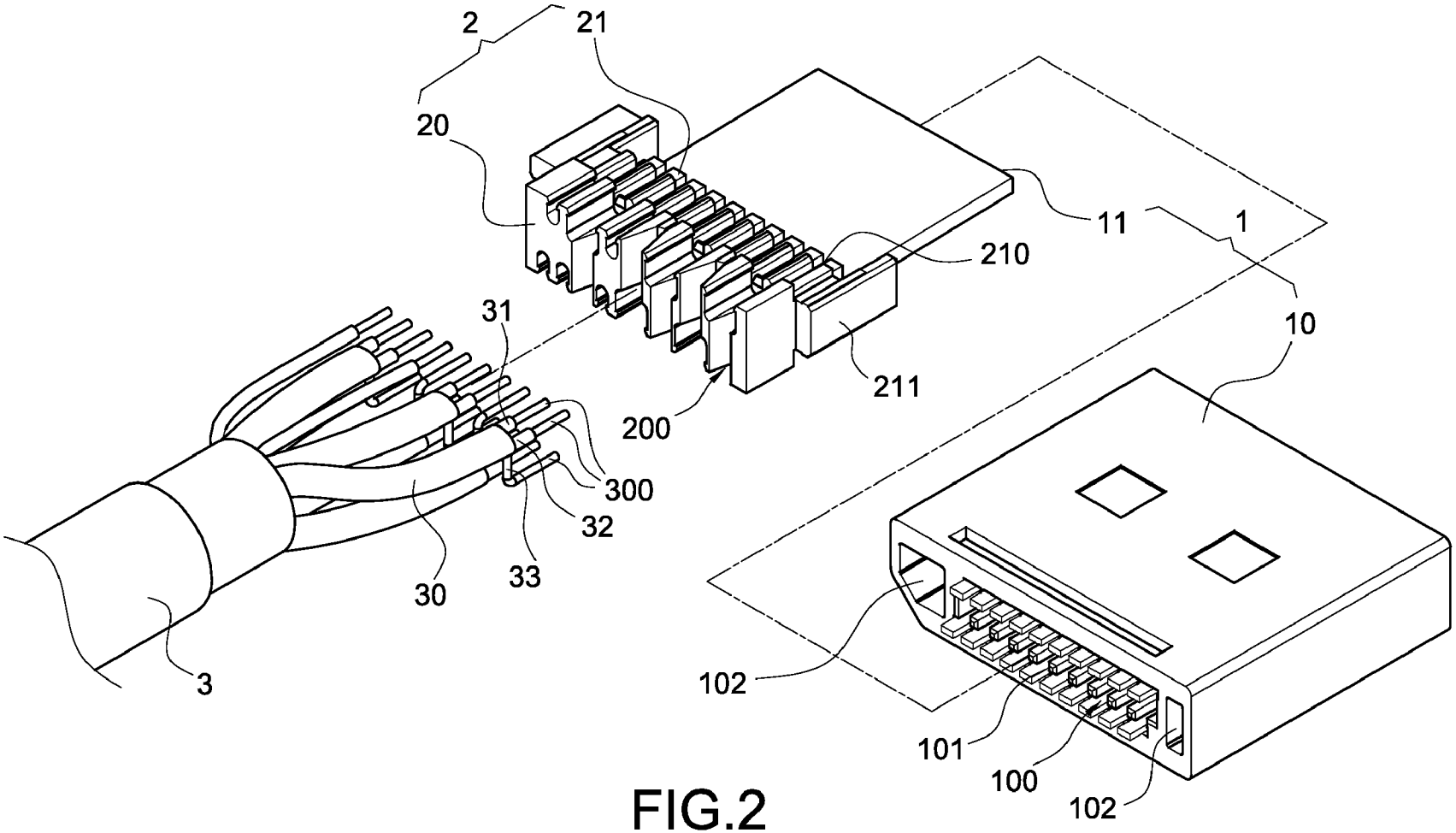
FIG. 2 is an exploded perspective view of the present invention.
Figure 3:
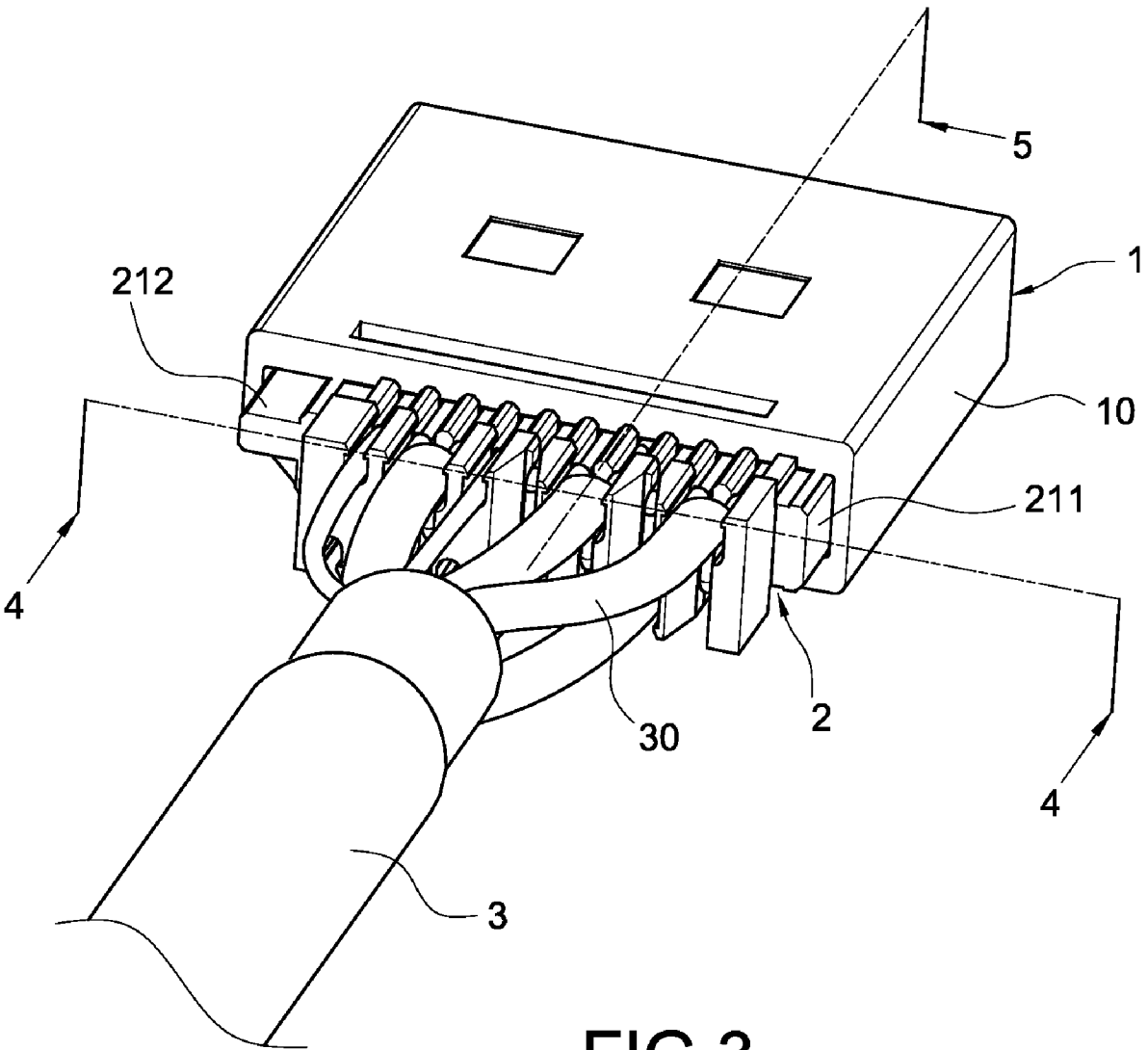
FIG. 3 is an assembled perspective view of the present invention.

Please refer to FIGS. 2 and 3, which are an exploded perspective view and an assembled view of the present invention respectively. The present invention provides a cable connector and a wiring assembly. The cable connector includes a connecting head 1, a wiring assembly 2 and a cable 3. The cable 3 is assembled with the wiring assembly 2, and then the wiring assembly 2 is assembled with the connecting head 1. Via this arrangement, the cable connector is obtained.

Figure 5:
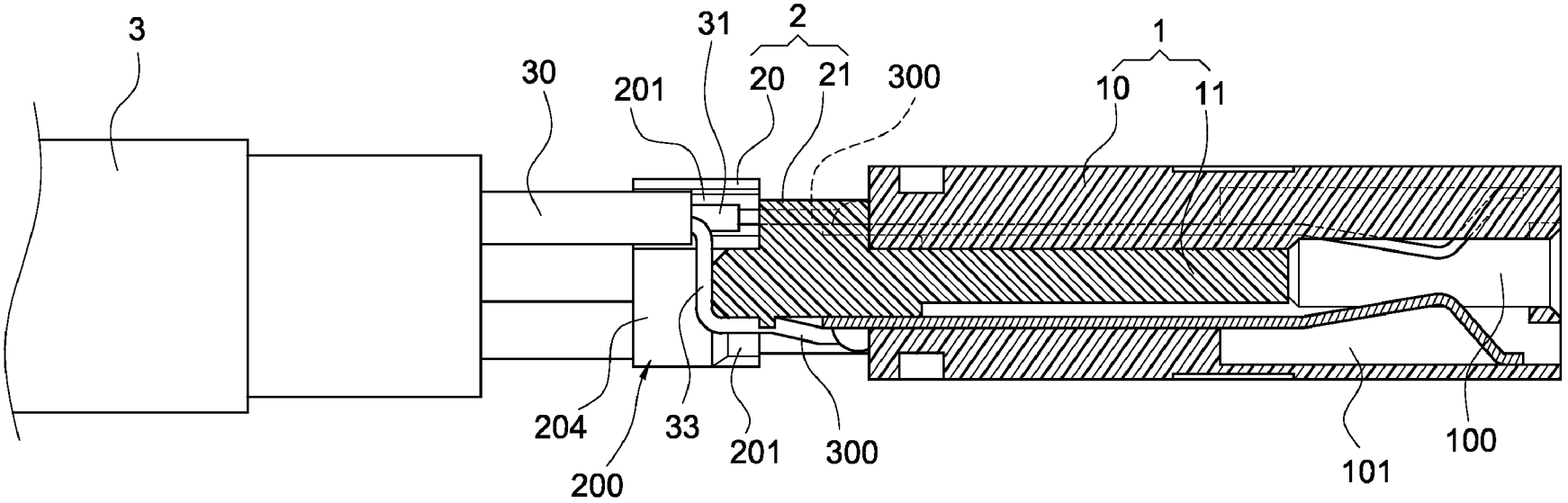
FIG. 5 is a cross-sectional view taken along the line 5-5 in FIG. 3.

The connecting head 1 comprises a casing 10 and an insulating body 11 provided in the casing 10. The front end of the casing 10 is recessed to form an insertion slot 100. The top and bottom of the insertion slot 100 are recessed to form a plurality of terminal seats 101 for allowing terminals to be disposed therein (FIG. 5). The insulating body 11 can be disposed horizontally between the top and bottom terminal seats 101 in the insertion slot 100 so as to be electrically connected with a corresponding socket (not shown).

The wiring assembly 2 is also made of an insulating material and formed into a block having a rear-half portion 20 and a front-half portion 21 that are connected to each other. Please also refer to FIG. 4. The distal end of the rear-half portion 20 is recessed inwards to form a plurality of wiring ports 200. Each of the wiring ports 200 is provided with a first cable trough 201, a second cable trough 202, a third cable trough 203 and a connecting cable trough 204. The first and second cable troughs 201, 202 are arranged transversely at intervals in a half portion that is divided by the upper and lower portions of the interior of single wiring port 200. The third cable trough 203 is located at the other half portion. The connecting cable trough 204 is connected between these two half portions and extends to the third cable trough 203. Further, in the embodiment of the present invention, the wiring ports 200 are staggered transversely at the distal end of the rear-half portion 20. Thus, in any two adjacent wiring ports 200, the positions of the first and second cable troughs 201, 202 are exactly opposite to the positions of the third cable troughs 203. Both inner sides of each wiring port 200 facing the third cable trough 203 and the connecting cable trough 204 are enlarged gradually toward the outside.

According to the above, the first, second, third and connecting cable troughs 201, 202, 203, 204 of each wiring port 200 extend further toward the front-half portion 21 of the wiring assembly 2, so that the top and bottom of the front-half portion 21 are formed with a plurality of wiring slots 210.

The cable 3 comprises the same number of bundles of cable cores 30 as the number of wiring ports 200. Each of the cable cores 30 comprises two transmission lines 31, 32 and a ground line 33 that are covered by the insulating layers. The distal ends of the transmission lines 31, 32 and the ground line 33 of each cable core 30 extend to form cable-baring portions 300. Please refer to FIG. 5. Each of the cable cores 30 is located at the corresponding wiring port 200. Then, the transmission lines 31, 32 and the ground line 33 of each cable core 30 are located at the corresponding first, second and third cable troughs 201, 202, 203 respectively. Thus, each of the cable-baring portions 300 of the cable 3 can be disposed in the correct wiring slot 210, and then soldered with respective terminal in the casing 10 to achieve electrical connection (FIG. 5). At the same time, since the ground line 33 of each cable core 30 is positioned via the connecting cable trough 204, the wiring procedure can be carried out easily.

Figure 4:
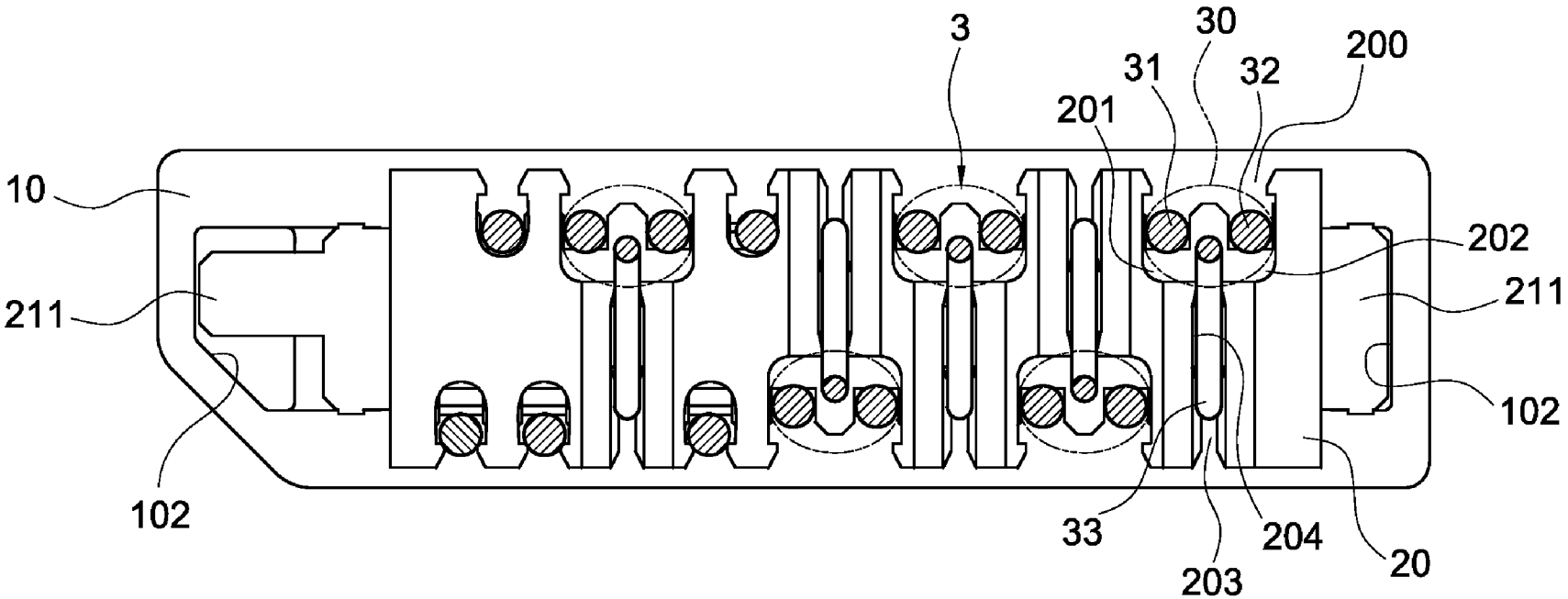
FIG. 4 is a cross-sectional view taken along the line 4-4 in FIG. 3.

Further, as shown in FIGS. 2, 3 and 4, both sides of the front-half portion 21 of the wiring assembly 2 are provided with an insertion arm 211. Further, both sides of the insulating body 10 are provided with an insertion slot 102 at positions corresponding to the insertion arms 211. With the two insertion arms 211 being inserted into the two insertion slots 102, the wiring assembly 2 can be assembled with the connecting head 1.

Via the above arrangement, the cable connector and the wiring assembly according to the present invention can be obtained.

According to the above, the present invention really achieves the expected objects and solves the problems of prior art. Further, the present invention demonstrates novelty and inventive steps, which conforms to the requirements for a utility model patent.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A cable connector, comprising;

a connecting head having a casing and an insulating body provided in the casing, a front end of the casing being recessed to form an insertion slot, top and bottom portions inside the insertion slot being recessed to form a plurality of terminal seats and terminals, the insulating body being disposed horizontally between top and bottom terminal seats in the insertion slot;

a wiring assembly having a rear-half portion and a front-half portion that are connected to each other, a distal end of the rear-half portion being recessed to form a plurality of wiring ports staggered transversely at the distal end of the rear-half portion of the wiring assembly, an interior of each wiring port being provided with a plurality of cable troughs, the cable troughs extending toward the front-half portion and abutting a plurality of wiring slots on the front-half portion, wherein the plurality of cable troughs in each wiring port further comprise a first cable trough, a second cable trough and a third cable trough, the first and second cable troughs are arranged transversely in a half portion divided by the upper and lower portions of each wiring port, and the third cable trough is located in the other half portion; and a cable having the same number of bundles of cable cores as the number of the wiring ports, the cable cores being located in corresponding wiring ports respectively, a distal end of each cable core extending to form a plurality of cable-baring portions to be disposed in the corresponding wiring slots and achieve electrical connection with the terminals.

2. The cable connector according to claim 1, wherein a connecting cable trough is provided between these two half portions, the connecting cable trough extends to the third cable trough.

3. The cable connector according to claim 2, wherein both inner sides of the wiring port facing the third cable trough and the connecting cable trough are enlarged gradually towards a rear half portion of the wiring assembly.

4. The cable connector according to claim 1, wherein the front-half portion of the wiring assembly is provided with insertion arms, insertion slots are provided in the insulating body of the connecting head to correspond to the insertion arms, the insertion arms are inserted into the insertion slots to thereby assembling the wiring assembly with the connecting head.

5. A wiring assembly of cable connector, formed into a block and having a rear-half portion and a front-half portion that are connected to each other;

wherein a distal end of the rear-half portion is recessed to form a plurality of wiring ports, an interior of each wiring port is staggered transversely at the distal end of the rear-half portion and is provided with a plurality of cable troughs, the cable troughs extend toward the front-half portion and abutting a plurality of wiring slots on the front-half portion;

wherein the plurality of cable troughs in each wiring port comprises a first cable trough, a second cable trough and a third cable trough, the first and second cable troughs are arranged transversely in a half portion divided by upper and lower portions of each wiring port, the third cable trough is located in the other half portion.

6. The wiring assembly of cable connector according to claim 5, wherein a connecting cable trough is provided between the two half portions, the connecting cable trough extends to the third cable trough.

7. The wiring assembly of cable connector according to claim 6, wherein both inner sides of the wiring port facing the third cable trough and the connecting cable trough are enlarged gradually in the direction towards the rear half portion.

* * * * *